US009453634B2

(12) United States Patent
Wegleiter et al.

(10) Patent No.: US 9,453,634 B2
(45) Date of Patent: Sep. 27, 2016

(54) OPTOELECTRONIC LIGHTING DEVICE AND METHOD FOR PRODUCING AN OPTOELECTRONIC LIGHTING DEVICE

(71) Applicant: OSRAM Opto Semiconductors GmbH, Regensburg (DE)

(72) Inventors: Walter Wegleiter, Nittendorf (DE); Andreas Plößl, Regensburg (DE); Frank Singer, Regenstauf (DE)

(73) Assignee: OSRAM Opto Semiconductors GmbH, Regensburg (DE)

( * ) Notice: Subject to any disclaimer, the term of this patent is extended or adjusted under 35 U.S.C. 154(b) by 140 days.

(21) Appl. No.: 14/484,069

(22) Filed: Sep. 11, 2014

(65) Prior Publication Data

US 2015/0070914 A1 Mar. 12, 2015

(30) Foreign Application Priority Data

Sep. 11, 2013 (DE) ..... 10 2013 109 986

(51) Int. Cl.

| | |
|---|---|
| ***F21V 17/00*** | (2006.01) |
| ***F21V 17/10*** | (2006.01) |
| ***F21K 99/00*** | (2016.01) |
| ***F21V 19/00*** | (2006.01) |
| ***F21V 21/096*** | (2006.01) |
| ***F21V 29/89*** | (2015.01) |
| *F21Y 101/02* | (2006.01) |

(52) U.S. Cl.

CPC ..... *F21V 17/105* (2013.01); *F21K 9/90* (2013.01); *F21V 19/003* (2013.01); *F21V 21/096* (2013.01); *F21V 29/89* (2015.01); *F21Y 2101/02* (2013.01); *Y10T 29/4913* (2015.01)

(58) Field of Classification Search

CPC .... F21V 29/22; F21V 17/105; F21V 19/003; F21V 21/096

USPC ..... 362/457

See application file for complete search history.

(56) References Cited

U.S. PATENT DOCUMENTS

| | | | | |
|---|---|---|---|---|
| 5,926,275 | A | 7/1999 | Sanders et al. | |
| 7,482,688 | B2 | 1/2009 | Glowinke | |
| 2007/0253165 | A1 | 11/2007 | Glowinke | |
| 2010/0314655 | A1* | 12/2010 | Thompson | F21K 9/00 257/99 |
| 2012/0120608 | A1 | 5/2012 | Guan | |

FOREIGN PATENT DOCUMENTS

| | | |
|---|---|---|
| DE | 69801435 T2 | 6/2002 |
| JP | 3141663 A | 6/1991 |

OTHER PUBLICATIONS

Mallinson, J.C., "One-Sided Fluxes—A Magnetic Curiosity," IEEE Transactions on Magnetics, vol. Mag-9, No. 4, Dec. 1973, pp. 678-682.

* cited by examiner

*Primary Examiner* — Karabi Guharay
(74) *Attorney, Agent, or Firm* — Slater Matsil, LLP

(57) ABSTRACT

An optoelectronic lighting device includes a lighting module with an optoelectronic semiconductor chip. A connection carrier has a first main surface and a second main surface facing away from the first main surface. The lighting module is arranged on the first main surface of the connection carrier, and the connection carrier adheres to a heat sink on account of a magnetic attraction.

18 Claims, 3 Drawing Sheets

OPTOELECTRONIC LIGHTING DEVICE AND METHOD FOR PRODUCING AN OPTOELECTRONIC LIGHTING DEVICE

This application claims the priority of German patent application 10 2013 109 986.6 filed on Sep. 11, 2013, which application is hereby incorporated herein by reference.

TECHNICAL FIELD

An optoelectronic lighting device and a method for producing an optoelectronic lighting device are specified.

SUMMARY

Embodiments of the invention specify an optoelectronic lighting device in which heat generated during operation is dissipated particularly efficiently.

Embodiments of the invention specify a method for producing an optoelectronic lighting device which saves material.

In accordance with at least one embodiment of the optoelectronic lighting device, the latter comprises a lighting module having an optoelectronic semiconductor chip. The optoelectronic semiconductor chip can be a light emitting diode chip, for example. The light emitting diode chip can generate electromagnetic radiation during operation. The light emitting diode chip generates infrared, visible and/or ultraviolet electromagnetic radiation, for example, during operation. A semiconductor layer sequence of the optoelectronic semiconductor chip can be based on a III-V compound semiconductor material. The III/V compound semiconductor material comprises at least one element from the third main group, such as, for example, B, Al, Ga, In, and an element from the fifth main group, such as N, P, As, for example. In particular, the term "III/V compound semiconductor material" encompasses the group of binary, ternary or quaternary compounds containing at least one element from the third main group and at least one element from the fifth main group, for example, nitride and phosphide compound semiconductors. Moreover, such a binary, ternary or quaternary compound can comprise, for example, one or more dopants and additional constituents. The III-V compound semiconductor material can comprise, for example, GaN, InGaN, AlGaN, InAlGaN, AlGaInP or AlGaInAs. The III-V compound semiconductor layer sequence can comprise, in particular, an active layer in which the electromagnetic radiation is generated during the operation of the semiconductor chip.

The optoelectronic semiconductor chip can, for example, be mounted in a cutout of a housing or on a carrier of the lighting module or be potted in a housing of the lighting module. The lighting module can thus comprise the housing or the carrier besides the optoelectronic semiconductor chip, in which case the lighting module can then be embodied in a self-supporting fashion. In the present connection, "self-supporting" is understood to mean that the lighting module is not mechanically supported and/or stabilized by a further component of the optoelectronic lighting device. The lighting module can be, in particular, prefabricated and/or surface-mountable. By way of example, the lighting module is a multi-chip LED module. The multi-chip LED module comprises a multiplicity of light emitting diode chips, for example. The lighting module furthermore comprises electrical connections which can be suitable for making electrical contact with the lighting module.

In accordance with at least one embodiment of the optoelectronic lighting device, the latter comprises a connection carrier having a first main surface and a second main surface facing away from the first main surface. In particular, the first main surface runs in lateral directions parallel to the second main surface. The lateral directions run parallel to a main extension direction of the connection carrier. The first main surface can be connected to the second main surface via a side surface of the connection carrier. The first main surface can be electrically insulated from the second main surface. By way of example, electrical contact can be made with the lighting module via the first main surface of the connection carrier. By way of example, the connection carrier can be magnetically mounted, arranged and/or fixed onto a further structural part and/or a further component of the optoelectronic lighting device by means of the second main surface.

The connection carrier can be a printed circuit board (PCB) or a leadframe. The connection carrier can comprise an electrically insulating main body. The electrically insulating main body comprises, for example, a thermosetting plastic material or thermoplastic material or a ceramic material, for example, silicon nitride ($Si_3N_4$), aluminum nitride (AlN) or aluminum oxide ceramics ($Al_2O_3$). Electrically conductive conductor tracks and/or electrically conductive connection locations can be introduced on and/or in the electrically insulating main body of the connection carrier.

Furthermore, the connection carrier can be a metal-core printed circuit board. The metal-core printed circuit board comprises an electrically conductive main body. The electrically conductive main body can comprise copper, a copper alloy, aluminum or an aluminum alloy or can consist of one of these materials. The electrically conductive main body can be electrically insulated or isolated from the electrically conductive conductor tracks and/or the electrically conductive connection locations by an electrically insulating layer. By way of example, an aluminum oxide layer could function as electrical insulation between the main body and the electrically conductive conductor tracks and/or the electrically conductive connection locations. The connection carrier can have, in particular, very good thermal conductivity.

In accordance with at least one embodiment of the optoelectronic lighting device, the latter comprises a heat sink. The heat sink can have, in particular, a planar region for linking, mounting and/or making contact with the connection carrier. The connection carrier can be arranged indirectly on the planar region of the heat sink. That is to say that, for example, a connecting component can be arranged between the connection carrier and the heat sink. The heat sink comprises, in particular, a material having very good thermal conductivity and heat dissipation. Such a material can be Cu or Al, for example. The heat sink can have cooling ribs in particular in a direction facing away from the connection carrier. On account of an increase in the surface area of the heat sink, the cooling ribs lead to better and faster heat dissipation toward the outside. The heat can be generated during the operation of the lighting module.

In accordance with at least one embodiment of the optoelectronic lighting device, the lighting module is arranged on the first main surface of the connection carrier. In particular, the lighting module can be electrically contact-connected to the first main surface of the connection carrier via the conductor tracks and/or connection locations described here. By way of example, the lighting module is soldered and/or adhesively bonded onto the first main surface of the connection carrier. In particular, the first main surface can have a solder resist layer for making electrical contact with the lighting module in a simplified manner.

In accordance with at least one embodiment of the optoelectronic lighting device, the connection carrier, by means of a connecting element, adheres to the heat sink on account of a magnetic attraction. The connecting element is arranged on the second main side of the connection carrier, for example, and forms the magnetic attraction, for example, with a coating of the heat sink that corresponds to the connecting element. It is furthermore conceivable for the connecting element to be arranged on and/or in the heat sink and to exert a magnetic attraction on a coating of the connection carrier. The magnetic attraction between the connection carrier and the heat sink is designed to be strong enough that the connection carrier adheres to the heat sink mechanically stably. In this connection, mechanically stably means, in particular, that the magnetic attraction can withstand at least ten times or a hundred times or a thousand times the gravitational force on the connection carrier or on the heat sink before the magnetic connection is released. In particular, the magnetic attraction can withstand a force of more than 0.5 N or more than 5 N or more than 30 N.

The mechanically stable connection between the connecting element and the abovementioned coating is preferably mediated predominantly or exclusively by magnetic forces; mechanical forces or adhesive forces play a minor or no part. For example, the stable connection is designed to be free of toothing or anchoring.

The connecting element comprises a ferromagnetic material, for example. Ferromagnetic materials are Fe, Ni and Co, for example. The connecting element can comprise in particular a ferromagnetic alloy, for example, Al—Ni—Co or Ni—Fe—Co. The connecting element can consist of a ferromagnetic material mentioned here or a ferromagnetic alloy. Furthermore, alloys or sintering bodies composed of rare earth metals such as, for example, samarium-cobalt (Sm—Co) or neodymium-iron-boron (Nd—Fe—B) are also conceivable for the connecting element. These materials are distinguished in particular by high magnetic attraction forces, in particular at room temperature. The connecting element has permanent-magnetic properties. The connecting element can be embodied as a separate body that can be fixed to a component of the lighting device. The connecting element can be arranged as a coating on one of the components of the lighting device.

In accordance with at least one embodiment of the optoelectronic lighting device, the latter comprises a lighting module having an optoelectronic semiconductor chip, a connection carrier having a first main surface and a second main surface facing away from the first main surface, and a heat sink, wherein the lighting module is arranged on the first main surface of the connection carrier, and the connection carrier, by means of a connecting element, adheres to the heat sink on account of a magnetic attraction.

The application makes use of the concept, inter alia, of using a connecting element for mechanically fixing and thermally coupling a lighting module onto a heat sink, such that a magnetic attraction forms between a connection carrier on which the lighting module is arranged and the heat sink. By means of the connecting element, the connection carrier adheres to the heat sink mechanically stably. The connecting element comprises a ferromagnetic material and exerts a magnetic attraction, for example, on a paramagnetic or ferromagnetic material. The paramagnetic or ferromagnetic material can then be correspondingly embodied on a connecting partner, for example, as a layer. By utilizing the magnetic attraction, it is possible for the heat of the lighting module that is generated during operation to be dissipated particularly efficiently in particular via the heat sink. This can be attributed to the fact that the magnetic attraction enables lateral sliding between connecting partners, in particular connecting element and heat sink, such that the contact area between the connecting partners is not reduced. Consequently, different material-specific coefficients of thermal expansion (CTE), in particular at high operating temperatures, are compensated for, without a deformation of the connecting partners reducing the contact area between the connecting partners and thus making it possible for the heat to be dissipated only poorly. In particular, mechanical connecting elements, for example, screws and/or clamps, are not used, since the magnetic attraction is mechanically stable. Furthermore, on account of the magnetic attraction, a uniform force input is exerted on the components of the optoelectronic lighting device.

In order to obtain a sufficiently good magnetic connection, a paramagnetic or ferromagnetic layer as described above has, for example, a thickness of at least 2 μm or at least 100 μm or at least 500 μm. Alternatively or additionally, the thickness of the paramagnetic or ferromagnetic layer is ≤1 mm or ≤700 μm or ≤500 μm. A spacing between paramagnetic or ferromagnetic layer and connecting element is, for example, at most 1 mm or at most 100 μm or at most 10 μm. In this case, the paramagnetic or ferromagnetic layer is preferably not itself embodied as a permanent magnet. The ferromagnetic layer comprises or consists of, for example, one of the following materials: Fe, Ni, Co, AlNiCo, NiFeCo, rare earth metal compounds, such as SmCo, NdFeB.

In accordance with at least one embodiment of the optoelectronic lighting device, the heat sink comprises a first contact region and a second contact region. The contact regions can be provided for mounting components of the optoelectronic lighting device. In particular, the contact regions are surfaces or side surfaces of the heat sink. The contact regions can be smooth and/or planar apart from a production-dictated roughness. The first contact region can be provided in particular for making magnetic contact with the connection carrier and the second contact region can be provided for applying an electrical contact for the connection carrier, for example. By way of example, the connecting element by means of which the connection carrier adheres mechanically stably on account of the magnetic attraction is arranged onto the first contact region. By way of example, the electrical contact can be arranged onto the second contact region. The electrical contact or an electrical contact-connection is electrically in contact in particular with the connection carrier. The first and second contact regions comprise the same material, for example.

In accordance with at least one embodiment of the optoelectronic lighting device, the first contact region runs parallel to the second contact region. The first contact region and the second contact region run parallel to the lateral directions. The first contact region and the second contact region can be embodied in a continuously planar fashion in particular when considered by themselves. That is to say that the contact regions have no interruptions, elevations and/or cutouts.

In accordance with at least one embodiment of the optoelectronic lighting device, the second contact region projects beyond the first contact region in a vertical direction. In this case, the vertical direction runs transversely, in particular perpendicularly, with respect to the lateral direction.

In accordance with at least one embodiment of the optoelectronic lighting device, a riser connects the first contact region to the second contact region in the vertical direction.

The riser is a perpendicular connecting element and connects the first contact region to the second contact region. The riser forms a right angle with the second contact region, for example.

In accordance with at least one embodiment of the optoelectronic lighting device, the connection carrier adjoins the riser of the heat sink and the connection carrier is in direct contact with the riser. By way of example, the side surface of the connection carrier is in direct contact with the riser. The riser simplifies, in particular, alignment or mounting of the connection body in the lateral direction. By way of example, the connection carrier, without being in contact with the heat sink areally, can firstly abut the riser and then be arranged areally onto the heat sink. The connection carrier can be arranged on the first contact region of the heat sink by means of the connecting element.

In accordance with at least one embodiment of the optoelectronic lighting device, the second contact region of the heat sink is free of a ferromagnetic material. The second contact region in particular does not comprise ferromagnetic material or is covered by such a material and in particular is not provided for mounting the connection carrier by means of the connecting element. By way of example, the second contact region is provided for applying an electrical contact element. The electrical contact element can be understood to mean, in particular, the electrical contact or the electrical contact-connection. The electrical contact element can be, in particular, an electrically conductive contact strip, a spring plug contact or a contact-making lug (also called: flex-layer). The electrical contact element electrically connects, for example, the first main surface of the connection carrier to the second contact region of the heat sink. The second contact region can be electrically insulated from the first contact region of the heat sink.

In accordance with at least one embodiment of the optoelectronic lighting device, the connecting element is embedded in the heat sink and forms the magnetic attraction with a paramagnetic or ferromagnetic coating on the second main surface of the connection carrier. In the present connection "embedded" is understood to mean that the connecting element does not alter an external form of the heat sink and is situated in the heat sink at least in places and an outer surface of the connecting element runs parallel to the first contact region of the heat sink. The outer surface of the connecting element together with the first contact region of the heat sink can form a planar surface that is smooth, for example, apart from a production-dictated roughness. The outer surface of the connecting element is free of a material of the heat sink. The connecting element can be embodied as a ferromagnet or as a permanent magnet. The paramagnetic or ferromagnetic coating on the second main surface of the connection carrier is attracted by the magnetic field of the connecting element and thus forms the magnetic attraction. Furthermore, the ferromagnetic coating has a polarity appropriate to the connecting element. The paramagnetic or ferromagnetic coating can cover the second main surface over the whole area and/or be in direct contact with the second main surface.

In particular, the connecting element and the paramagnetic or ferromagnetic layer are in direct contact with one another or are spaced apart from one another by means of a layer, for example, a heat conducting layer, such as a thermally conductive paste.

In accordance with at least one embodiment of the optoelectronic lighting device, the connecting element comprises a plurality of permanent magnets and the permanent magnets are arranged in accordance with a Halbach array with respect to one another. In the present connection, "Halbach array" is understood to mean a specific configuration of permanent magnets. Such a configuration makes it possible for the magnetic flux—that is to say the magnetic field—to be almost canceled at one side of the configuration and the magnetic field to be amplified on the opposite side. In other words, a one-sided magnetic attraction of the connecting element in the direction of the heat sink can be achieved on the basis of the Halbach array. The connecting element can comprise, for example, a permanent-magnetic layer with permanent magnets arranged in accordance with the Halbach array with respect to one another.

In accordance with at least one embodiment of the optoelectronic lighting device, the magnetic attraction forms between the connecting element arranged on the second main surface of the connection carrier and a paramagnetic or ferromagnetic coating of the heat sink. The ferromagnetic coating of the heat sink then has the appropriate polarity with respect to the connecting element. The connecting element, as a ferromagnetic or permanent-magnetic coating, can, for example, completely cover the second main surface of the connection carrier or be in direct contact with the second main surface. The connecting element can comprise a samarium-cobalt (Sm—Co) alloy. The connecting element can also be arranged in a segmented fashion on the second main surface of the connection carrier. By way of example, the connecting element can comprise a multiplicity of relatively small permanent-magnetic regions. By means of the connecting element of the connection carrier, the paramagnetic or ferromagnetic coating of the heat sink is magnetized and the magnetic attraction described here forms. The paramagnetic or ferromagnetic coating can be arranged in particular completely on the first contact region of the heat sink.

In accordance with at least one embodiment of the optoelectronic lighting device, the connecting element is arranged onto the connection carrier from a side of the connection carrier facing the first main surface, wherein the magnetic attraction extends at least partly through the connection carrier in the direction of the heat sink and forms the magnetic attraction with the heat sink. In this case, the connecting element can be embodied as a film or as a rigid body. The connecting element can be prefabricated, in particular. Furthermore, it is conceivable for the connecting element to have been stamped and/or cut out from a prefabricated film. The magnetic field of the connecting element is preferably larger than the geometrical dimensions of the connection carrier.

The film can comprise, for example, a silicone film having permanent-magnetic particles. The magnetic attraction forms, for example, between the connecting element and the paramagnetic or ferromagnetic coating on the heat sink, wherein the connection carrier is situated between the connecting element and the heat sink.

The connecting element can be applied to the connection carrier and/or the lighting module in particular in a positively locking manner and can fill, for example, crevices or gaps in the connection carrier or in the lighting module or between connection carrier and lighting module in a positively locking manner. A mechanical connection between the connection carrier/lighting module and the connecting element is achieved, for example, by means of an adhesive or by means of anchoring or toothings.

In accordance with at least one embodiment of the optoelectronic lighting device, the connecting element projects beyond the connection carrier at least in places in a lateral direction. By way of example, the connecting element is in direct contact at least in places with the first main surface and the side surface of the connection carrier. In particular, the connecting element can form a common interface at least in places with the first contact region of the heat sink. In other words, the connecting element covers the lighting module completely, wherein a radiation-transmissive component can be arranged at a radiation exit surface of the lighting module. The radiation-transmissive component prevents, in particular, the electromagnetic radiation from being absorbed by the connecting element.

In accordance with at least one embodiment of the optoelectronic lighting device, the heat sink projects beyond the connection carrier in the lateral direction. The lateral extent of the heat sink is thus greater than that of the connection carrier. The heat generated during operation can thus be dissipated toward the outside faster on account of the larger surface area of the heat sink. Furthermore, a larger area is available for arranging the connection body by means of the connecting element. This simplifies the process of arranging the connection carrier onto the heat sink.

In accordance with at least one embodiment, the heat sink has a plurality of cavities extending as cutouts proceeding from the first contact region into the heat sink. The cavities can have rib-type or strip-type or rectangular cross-sectional shapes, for example, in a plan view of the first contact region.

In accordance with at least one embodiment, the cavities in the heat sink are partly or completely filled with the connecting element. The connecting element fills the cavities in particular in a positively locking manner and is mechanically fixedly connected to the heat sink. Detachment or release of the connecting element is then not provided during envisaged operation. The mechanical connection between heat sink and connecting element is achieved, for example, by means of an adhesive or anchorings or toothings.

In particular, the connecting element can terminate flush with the first contact region, such that the heat sink and the connecting element form a planar surface facing the connection carrier. The connecting element is then divided into a plurality of individual connecting elements embodied as individual strips or ribs, for example, depending on the form of the cavities.

What is advantageously achieved by means of such an embodiment is that the connection carrier is in direct or indirect contact with the heat sink in the region laterally alongside or between the cavities and is not spaced apart from the heat sink by a ferromagnetic connecting element in these regions. In actual fact, ferromagnetic materials often have poor thermal conductivity, for which reason heat can be dissipated from the connection carrier more poorly via the connecting element. The above embodiment offers a compromise between good magnetic connection between connection carrier and heat sink in the region of the cavities, on the one hand, and good heat transfer in regions laterally alongside and between the cavities, on the other hand.

In accordance with at least one embodiment, a metallization is applied partly or over the whole area onto the heat sink in the first contact region in regions laterally alongside or between the cavities. The metallization brings about, for example, a spacing between connection carrier and heat sink in the region of the cavities, such that no direct contact between connection carrier and heat sink occurs in the region of the cavities. That can lead to a further optimization of the heat dissipation between connection carrier and heat sink. The metallization comprises or consists of, for example, one of the following materials: Cu, Ni, Au.

Furthermore, a method for producing an optoelectronic lighting device is described. By way of example, an optoelectronic lighting device described here can be produced by means of the method. That is to say that the features presented for the method described here are also disclosed for an optoelectronic lighting device described here, and vice versa.

In accordance with one embodiment of the method, a step A involves providing a connection carrier and a connecting element, wherein a lighting module having an optoelectronic semiconductor chip is arranged on the connection carrier. The connecting element comprises, for example, a ferromagnetic material or a ferromagnetic alloy and can be embodied as a permanent-magnetic coating. The connecting element can be arranged, for example, on the second main surface of the connection carrier. A main body of the connection carrier can comprise a silicon nitride ($Si_3N_4$), for example, and the lighting module can be electrically contact-connected via conductor tracks of the connection carrier. The connecting element can completely cover that side of the connection carrier which faces away from the lighting module, and can be in direct contact with the side.

In accordance with at least one embodiment of the method, a step B involves providing a heat sink having a contact region facing the connection carrier, wherein the contact region has a paramagnetic or ferromagnetic coating at least in places. The paramagnetic or ferromagnetic coating can be in direct contact in particular with the first planar contact region of the heat sink and can completely cover it. By way of example, the heat sink consists of Al and has a paramagnetic or ferromagnetic coating in particular on the first contact region. Furthermore, by way of example, the entire heat sink including the cooling ribs and the second contact region can be covered by the paramagnetic or ferromagnetic coating.

In accordance with at least one embodiment of the method, in a step C, a magnetic attraction force of the connecting element is reduced by heating the connecting element to at least one fifth of its Curie temperature. A temperature at which, when reached, ferromagnetic properties of a material have completely disappeared, such that the material is only paramagnetic above the temperature, is designated as the Curie temperature $T_C$ (after Pierre Curie). The Curie temperature is measured here in particular relative to 0° C. By way of example a connecting element composed of Fe, the Curie temperature of which is 760° C., can be heated to a temperature of approximately 150° C., such that the magnetic attraction is reduced in comparison at room temperature and, consequently, positioning or mounting of the connection carrier onto the heat sink by means of the connecting element is not impeded by strong magnetic attraction. Furthermore, it is conceivable for a connecting element having a Curie temperature of approximately 200° C. to be used, for example, for a coating of the connection carrier. Consequently, heating the connecting element to 200° C. would then lead to the magnetic attraction being temporarily eliminated. Positioning of the connection carrier by means of the connecting element would then be possible without the effect of magnetic attraction.

In accordance with at least one embodiment of the method, a step D involves arranging the connection carrier onto the paramagnetic or ferromagnetic coating of the heat sink by means of the connecting element. On account of the herein described temporary reduction or elimination of the magnetic attraction by the heating of the connecting element, the arrangement of the connecting element can be carried out in a particularly simple manner. Furthermore, the riser described herein can additionally simplify the alignment of the connection carrier in the lateral direction.

In accordance with at least one embodiment of the method, a step E involves increasing the magnetic attraction force of the connecting element by cooling the connecting element. As a result, the connecting element reacquires, in particular, its magnetic attraction present at room temperature, and the magnetic field formed by the connecting element attracts the paramagnetic or ferromagnetic coating.

In accordance with at least one embodiment, the method is carried out in the order A to E indicated here.

In accordance with at least one embodiment of the method for producing an optoelectronic lighting device, a step A involves providing a connection carrier and a connecting element, wherein a lighting module having an optoelectronic semiconductor chip is arranged on the connection carrier. A step B involves providing a heat sink having a contact region facing the connection carrier, wherein the contact region has a paramagnetic or ferromagnetic coating at least in places. A step C involves reducing a magnetic attraction force of the connecting element by heating the connecting element to at least one fifth of its Curie temperature. A step D involves arranging the connection carrier onto the paramagnetic or ferromagnetic coating of the heat sink by means of the connecting element. A step E involves increasing the magnetic attraction force of the connecting element by cooling the connecting element.

An optoelectronic lighting device described herein and a method for producing an optoelectronic lighting device are explained below on the basis of exemplary embodiments with associated figures.

BRIEF DESCRIPTION OF THE DRAWINGS

Elements that are identical, of identical type or act identically are provided with the same reference signs in the figures. The figures and the size relationships of the elements illustrated in the figures among one another should not be regarded as to scale. However, individual elements may be illustrated with an exaggerated size in order to enable better illustration and/or in order to afford a better understanding.

DETAILED DESCRIPTION OF ILLUSTRATIVE EMBODIMENTS

Figure 1:
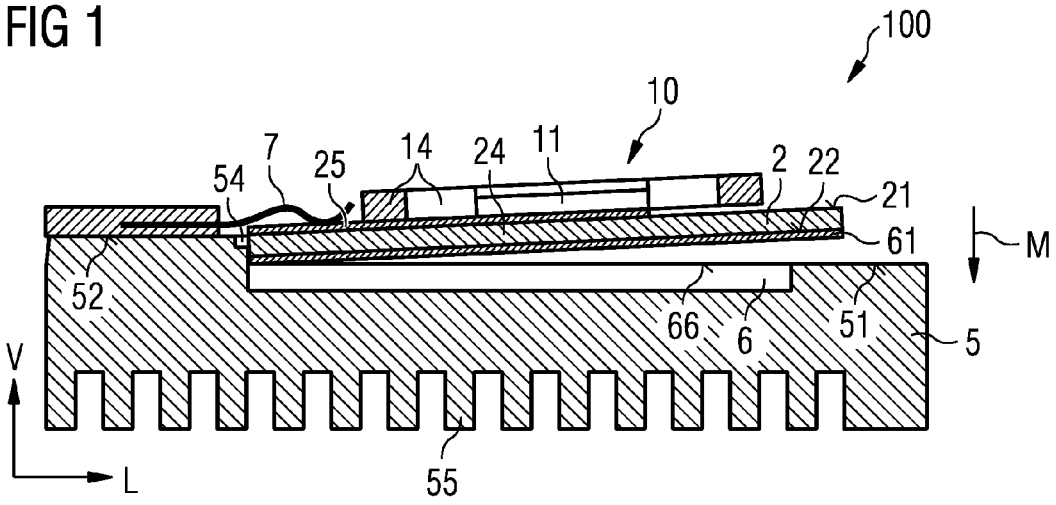
FIG. 1 shows, on the basis of a schematic exemplary embodiment, mounting of a connection carrier with lighting module onto a heat sink by means of the connecting element with the aid of a riser of the heat sink in order to produce the optoelectronic lighting device.

FIG. 1 shows an optoelectronic lighting device 100 described herein. The optoelectronic lighting device 100 comprises a lighting module 10 having an optoelectronic semiconductor chip 11 and a housing 14. The lighting module 10 can be a multi-chip LED module, for example. The optoelectronic lighting device 100 comprises a connection carrier 2 having a first main surface 21 and a second main surface 22 facing away from the first main surface 21. The connection carrier 2 comprises a main body 24 and conductor tracks 25 arranged on the first main surface 21 of the connection carrier 2. The lighting module 10 is arranged on the first main surface 21 of the connection carrier 2 by way of the conductor tracks 25, and electrical contact is made with the lighting module 10 in particular via the connection carrier 2 by means of an electrical contact-connection 7. The electrical connection 7 is embodied as a spring plug contact in FIG. 1.

The optoelectronic lighting device 100 in FIG. 1 exhibits a heat sink 5 having a first contact region 51 and a second contact region 52. The heat sink 5 can in particular comprise Cu or Al or consist of one of these materials. The electrical connection 7 is situated on the second contact region 52 of the heat sink 5. The first contact region 51 runs parallel to the second contact region 52 in lateral directions L. The lateral directions L run parallel to a main extension direction of the heat sink 5. The second contact region 52 projects beyond the first contact region 51 in a vertical direction V. The vertical direction V runs perpendicularly to the lateral directions L. A riser 53 connects the first contact region 51 to the second contact region 52 in the vertical direction V. The riser 53 forms a right angle 54 with the second contact region 52. The connection carrier 2 abuts the riser 53 in the lateral direction during mounting of the connection carrier 2. Consequently, an arrangement of the connection carrier 2 onto the first contact region 51 of the heat sink 5 is particularly simple and time-efficient.

In FIG. 1, the connecting element 6 is embedded as a permanent magnet in the heat sink. As shown in FIG. 1, an outer surface 66 of the connecting element 6 together with the first contact region 51 of the heat sink 5 forms a common planar surface. The outer surface 66 of the connecting element 6 faces the connection carrier 2, wherein the outer surface 66 of the connecting element 6 terminates flush with the first contact region 51 of the heat sink 5. A paramagnetic or ferromagnetic coating 61 is formed on the second main surface 22 of the connection carrier 2, the coating being in direct contact with the second main surface 22 and completely covering the latter. The connecting element 6 forms a magnetic field which forms a magnetic attraction M on the paramagnetic or ferromagnetic coating 61 of the connection carrier 2. By means of the connecting element 6, the connection carrier 2 adheres to the heat sink 5 on account of the magnetic attraction M which proceeds from the connecting element 6 and forms between the connection carrier 2 and the heat sink 5. The magnetic attraction M is represented by an arrow in FIG. 1.

The heat sink 5 has cooling ribs 55 on a side facing away from the connection carrier 2. The cooling ribs 55 lead, in particular, to an increase in the surface area of the heat sink 5, such that the heat of the lighting module 10 that is generated during operation can be dissipated toward the outside rapidly and efficiently. The heat sink 5 projects beyond the connection carrier 2 in the lateral directions L.

With regard to mounting of the connection carrier 2 onto the connecting element 6 embedded in the heat sink 5, it is possible, in particular, for the magnetic attraction force M of the connecting element 6 to be attenuated by the connecting element 6 being heated to at least one fifth of its Curie temperature. The magnetic field generated by the connecting element 6 is attenuated as a result. By way of example, an arrangement of the connection carrier 2 onto the connecting element 6 by means of the paramagnetic or ferromagnetic coating 61 can thus be simplified since the attenuated magnetic attraction M impedes to a lesser extent a displacement of the connection carrier 2 by means of the paramagnetic or ferromagnetic coating 61 on the connecting element 6. Once the connection carrier 2 has attained the desired position on the connecting element 6, the magnetic attraction M of the connecting element 6 can be increased again by cooling the connecting element 6 to room temperature.

Figure 2:
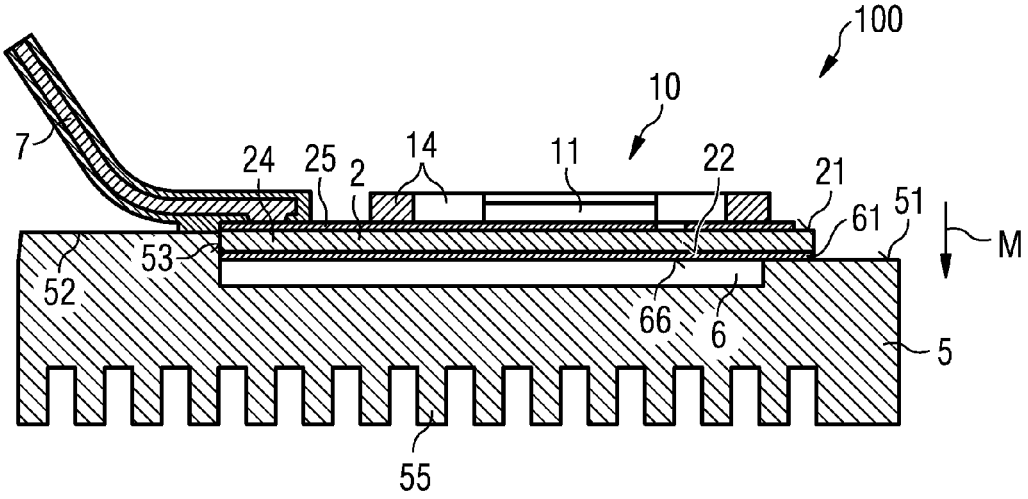
FIG. 2 shows, on the basis of a schematic exemplary embodiment, a variant of the optoelectronic lighting device.

FIG. 2 shows a schematic illustration of the optoelectronic lighting device 100 as in FIG. 1, with the difference that the connection carrier 2 adheres indirectly on the embedded connecting element 6 areally by means of its paramagnetic or ferromagnetic coating 61. Furthermore, in FIG. 2, electrical contact is made with the lighting module 10 via the first main surface 21 of the connection carrier 2 by means of the electrical contact-connection 7 in the form of a contact-making lug, wherein the electrical contact-connection 7 is in direct contact with the second contact region 52 at least in places.

In FIG. 1 and in FIG. 2, the second contact region 52 of the heat sink 5 is free of a magnetic material. Furthermore, the second contact region 52 of the heat sink 5 in FIGS. 1 and 2 is electrically insulated from the first contact region 51 of the heat sink 5.

Figure 3:
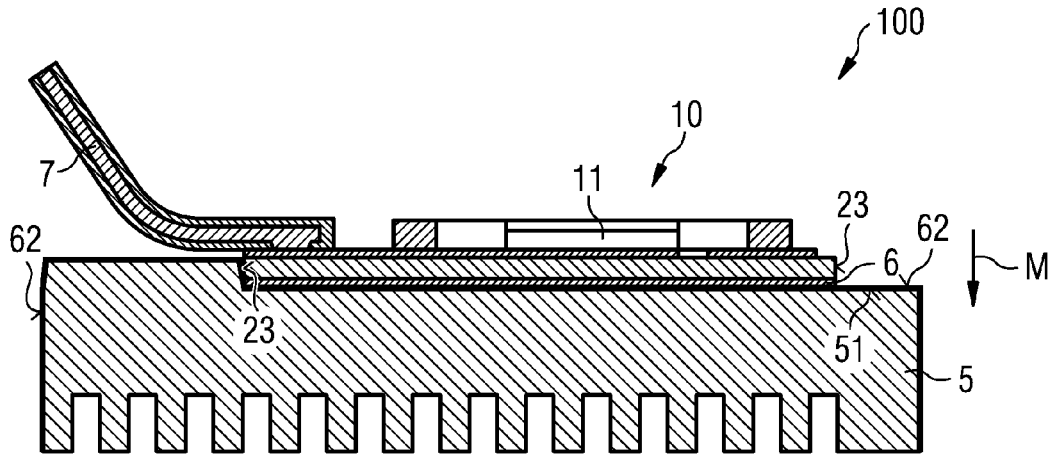
FIG. 3 shows, on the basis of a schematic exemplary embodiment, a further variant of the optoelectronic lighting device described herein which has been produced by the method described herein.

In the case of the optoelectronic lighting device 100 shown in FIG. 3, the magnetic attraction M is formed between the connecting element 6 arranged on the second main surface 22 of the connection carrier 2 and a paramagnetic or ferromagnetic coating 62 of the heat sink 5. The connecting element 6 is embodied as a permanent-magnetic coating in FIG. 3. The connecting element 6 consists of a samarium-cobalt alloy, for example. The paramagnetic or ferromagnetic coating 62 of the heat sink 5 can comprise an Ni coating, and the heat sink 5 itself can consist of Al. The paramagnetic or ferromagnetic coating 62 of the heat sink 5 can be formed in particular at outer surfaces of the heat sink 5; in particular, the first contact region 51 and the second contact region 52 and the riser 53 of the heat sink 5 are coated by the paramagnetic or ferromagnetic coating 62, wherein the cooling ribs 55 are free of the paramagnetic or ferromagnetic coating 62 of the heat sink 5.

In FIG. 3, in order to avoid an electrical short circuit, the electrical contact-connection 7 is not in contact with the second contact region 52 of the heat sink 5. In order to avoid an electrical short circuit, a side surface 23 that connects the first main surface 21 to the second main surface 22 of the connection carrier 2 is free of an electrically conductive material. As a result, electrical contact can be made with the lighting module 10 via the first main surface 21 of the connection carrier 2 by means of the electrical contact-connection 7. The optoelectronic lighting device shown in FIG. 3 can be produced by the herein described method comprising steps A to E.

Figure 4:
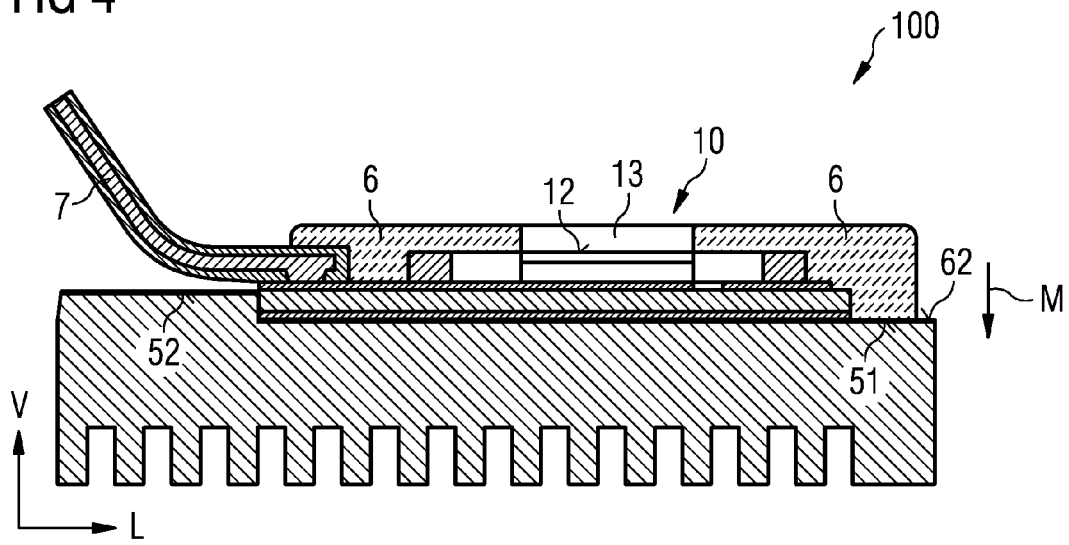
FIG. 4 shows, on the basis of a further schematic exemplary embodiment, a further variant of the optoelectronic lighting device described herein.

In the case of the optoelectronic lighting device 100 shown in FIG. 4, a schematic exemplary embodiment of the optoelectronic lighting device 100 as in FIG. 3 is shown, with the difference that the connecting element 6 is not embodied as a permanent-magnetic coating, but rather as a film. The connecting element 6 can comprise a silicone film having permanent-magnetic particles, for example, and is arranged on the connection carrier 2 from a side of the connection carrier 2 facing the first main surface 21. The magnetic attraction M of the connecting element 6 extends through the connection carrier 2 in the direction of the heat sink 5, wherein the paramagnetic or ferromagnetic coating 62 can be arranged on the heat sink. In FIG. 4, the connecting element 6 projects beyond the connection carrier at least in places in the lateral directions L, wherein the electrical contact-connection 7 can also be covered with the connecting element 6 at least in places.

In FIG. 4, the connection carrier 2 can be free of a material of the connecting element 6 at its first main surface 21 and second main surface 22. The magnetic attraction M formed between the connecting element 6 present in the form of a film and the heat sink 5 suffices to fix the connection carrier 2 mechanically stably on the heat sink. The coating on the second main surface 22 of the connection carrier 2 is therefore optional. In FIG. 4, a transparent and/or radiation-transmissive component 13 is disposed downstream on a radiation exit surface 12 of the lighting module 10, such that the radiation of the lighting module 10 that is generated during operation cannot be absorbed by the connecting element 6.

Figure 5:
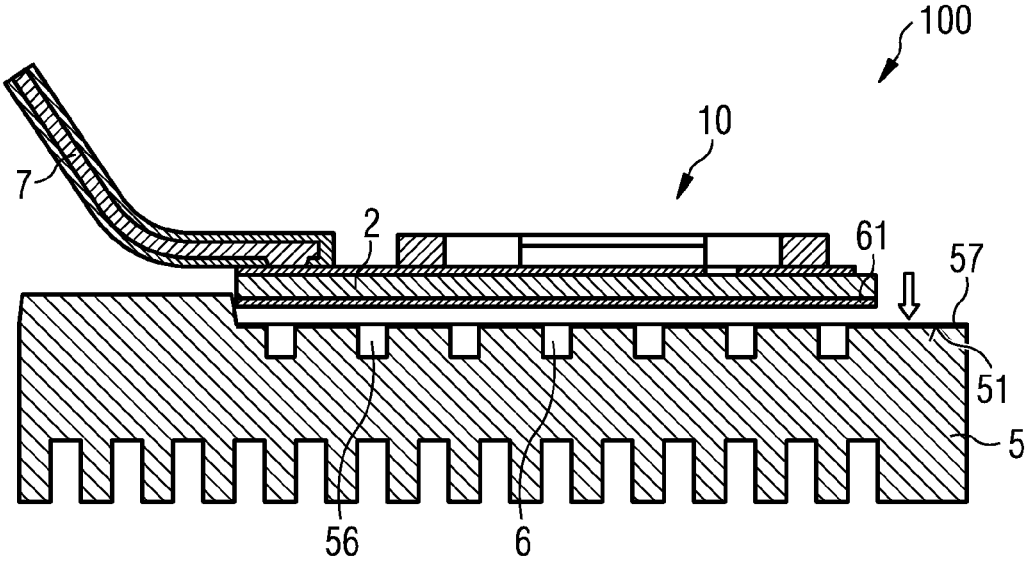
FIG. 5 shows, on the basis of a further schematic exemplary embodiment, a further variant optoelectronic lighting device.

FIG. 5 shows a further optoelectronic lighting device 100, wherein the heat sink 5 has in the first contact region 51 a plurality of cavities 56 extending as cutouts proceeding from the first contact region 51 into the heat sink 5. In the present case, the cavities 56 form a plurality of strip-type cutouts arranged laterally alongside one another in the heat sink 5. The cavities 56 are filled with the connecting element 6. However, the connecting element 6 does not project beyond the heat sink 5 in a direction away from the first contact region 51. In this case, directions parallel to a main extension direction of the connection carrier 2 are lateral directions. In this case, "arranged alongside one another in a strip-type fashion" should be understood to mean that, in a plan view of the contact region 51, the cavities 56 appear as strips lying alongside one another.

In regions laterally alongside or between the cavities 56, the first contact region 51 is free of the connecting element 6. These regions are covered with a metallization 57 composed of Cu, for example. In this case, the metallization 57 ensures that the connection carrier 2 and the connecting element 6 are not in direct contact with one another in the region of the cavities 56.

The invention is not restricted to the exemplary embodiments by the description on the basis of the exemplary embodiments. Rather, the invention encompasses any novel feature and also any combination of features, which in particular includes any combination of features in the patent claims, even if this feature or this combination itself is not explicitly specified in the patent claims or exemplary embodiments.

What is claimed is:

1. An optoelectronic lighting device comprising:

a connection carrier having a first main surface and a second main surface facing away from the first main surface;

a lighting module arranged on the first main surface of the connection carrier, the lighting module comprising an optoelectronic semiconductor chip;

a heat sink comprising:

a first contact region and a second contact region, wherein the first contact region runs parallel to the second contact region, and wherein the second contact region projects beyond the first contact region in a vertical direction; and a riser connecting the first contact region to the second contact region in the vertical direction; and a connecting element, wherein the connection carrier, by use of the connecting element, adheres to the heat sink on account of a magnetic attraction.

2. The optoelectronic lighting device according to claim 1, wherein the connection carrier adjoins the riser of the heat sink and is in direct contact with the riser.

3. The optoelectronic lighting device according to claim 1, wherein the second contact region of the heat sink is free of a ferromagnetic material.

4. The optoelectronic lighting device according to claim 1, wherein the connecting element is embedded in the heat sink.

5. The optoelectronic lighting device according to claim 4, wherein the connecting element forms the magnetic attraction with a paramagnetic or ferromagnetic coating on the second main surface of the connection carrier.

6. The optoelectronic lighting device according to claim 4, wherein the connecting element comprises a plurality of permanent magnets.

7. The optoelectronic lighting device according to claim 6, wherein the permanent magnets are arranged in accordance with a Halbach array with respect to one another.

8. The optoelectronic lighting device according to claim 7, wherein the connecting element forms the magnetic attraction with a paramagnetic or ferromagnetic coating on the second main surface of the connection carrier.

9. The optoelectronic lighting device according to claim 1, wherein the magnetic attraction forms between the connecting element arranged on the second main surface of the connection carrier and a paramagnetic or ferromagnetic coating of the heat sink.

10. The optoelectronic lighting device according to claim 1, wherein the connecting element is embodied as a film and is arranged onto the connection carrier from a side of the connection carrier facing the first main surface, wherein the magnetic attraction extends through the connection carrier in the direction of the heat sink.

11. The optoelectronic lighting device according to claim 10, wherein the connecting element projects beyond the connection carrier at least in places in a lateral direction.

12. The optoelectronic lighting device according to claim 1, wherein the heat sink projects beyond the connection carrier in a lateral direction.

13. The optoelectronic lighting device according to claim 1, wherein the heat sink has a plurality of cavities extending as cutouts into the heat sink;

the cavities in the heat sink are partly or completely filled with the connecting element; and the connection carrier is in direct or indirect contact with the heat sink in a region laterally alongside or between the cavities and is not spaced apart from the heat sink by the connecting element in these regions.

14. The optoelectronic lighting device according to claim 13, further comprising a spacer layer overlying at least a portion of the heat sink in a contact region located laterally alongside or between the cavities, wherein the spacer layer brings about a spacing between connection carrier and heat sink in the region of the cavities, such that no direct contact between connection carrier and heat sink occurs in the region of the cavities.

15. The optoelectronic lighting device according to claim 14, wherein the spacer layer comprises a metallization.

16. A method for producing an optoelectronic lighting device, the method comprising:

providing a connection carrier and a connecting element, wherein a lighting module having an optoelectronic semiconductor chip is arranged on the connection carrier;

providing a heat sink having a contact region facing the connection carrier, wherein the contact region has a paramagnetic or ferromagnetic coating at least in places;

reducing a magnetic attraction force of the connecting element by heating the connecting element to at least one fifth of a Curie temperature of the connecting element;

arranging the connection carrier onto the paramagnetic or ferromagnetic coating of the heat sink by use of the connecting element; and increasing the magnetic attraction force of the connecting element by cooling the connecting element.

17. An optoelectronic lighting device comprising:

a connection carrier having a first main surface and a second main surface facing away from the first main surface;

a lighting module arranged on the first main surface of the connection carrier, the lighting module comprising an optoelectronic semiconductor chip;

a heat sink; and a connecting element, wherein the connection carrier, by use of the connecting element, adheres to the heat sink on account of a magnetic attraction, wherein the connecting element is embodied as a film and is arranged on the connection carrier from a side of the connection carrier facing the first main surface, and wherein the magnetic attraction extends through the connection carrier in a direction of the heat sink.

18. An optoelectronic lighting device comprising:

a connection carrier having a first main surface and a second main surface facing away from the first main surface;

a lighting module arranged on the first main surface of the connection carrier, the lighting module comprising an optoelectronic semiconductor chip;

a heat sink; and a connecting element, wherein the connection carrier, by use of the connecting element, adheres to the heat sink on account of a magnetic attraction, wherein the heat sink has a plurality of cavities extending as cutouts into the heat sink, wherein the cavities in the heat sink are partly or completely filled with the connecting element, and wherein the connection carrier is in direct or indirect contact with the heat sink in a region laterally alongside or between the cavities and is not spaced apart from the heat sink by the connecting element in these regions.

* * * * *